US010634162B2

(12) United States Patent
Sasajima et al.

(10) Patent No.: US 10,634,162 B2
(45) Date of Patent: Apr. 28, 2020

(54) AXIAL FAN

(71) Applicant: Minebea Mitsumi Inc., Nagano (JP)

(72) Inventors: Tomoyoshi Sasajima, Takasago (JP); Yukihiro Higuchi, Fukuroi (JP); Naoya Murakami, Fukuroi (JP); Koichi Takeda, Fukuroi (JP)

(73) Assignee: MINEBEA MITSUMI INC., Nagano (JP)

( * ) Notice: Subject to any disclaimer, the term of this patent is extended or adjusted under 35 U.S.C. 154(b) by 136 days.

(21) Appl. No.: 15/944,901

(22) Filed: Apr. 4, 2018

(65) Prior Publication Data

US 2018/0223862 A1 Aug. 9, 2018

Related U.S. Application Data

(63) Continuation of application No. PCT/JP2016/079783, filed on Oct. 6, 2016.

(30) Foreign Application Priority Data

Oct. 7, 2015 (JP) ..... 2015-199714

(51) Int. Cl.
*F04D 29/38* (2006.01)
*F04D 19/00* (2006.01)
*F04D 29/32* (2006.01)

(52) U.S. Cl.
CPC ..... *F04D 29/384* (2013.01); *F04D 19/002* (2013.01); *F04D 29/325* (2013.01); *F05D 2240/305* (2013.01)

(58) Field of Classification Search
CPC .... F04D 29/384; F04D 29/325; F04D 29/281; F04D 19/002
See application file for complete search history.

(56) References Cited

U.S. PATENT DOCUMENTS 6,116,856 A 9/2000 Karadgy et al.
6,206,641 B1 * 3/2001 Park ..... F04D 29/384 416/182

(Continued)

FOREIGN PATENT DOCUMENTS

CN 101096965 A 1/2008
CN 101135319 A 3/2008

(Continued)

OTHER PUBLICATIONS

International Search Report for corresponding International Application No. PCT/JP2016/079783 dated Dec. 19, 2016.

(Continued)

*Primary Examiner* — Kenneth J Hansen
*Assistant Examiner* — Jackson N Gillenwaters
(74) *Attorney, Agent, or Firm* — Pearne & Gordon LLP

(57) ABSTRACT

An axial fan comprises an impeller. The impeller comprises a hub and a plurality of blades disposed on an outer circumference of the hub. A pressure surface of each of the blades is at least partially a convex surface bulging from a suction surface side to a pressure surface side. The convex surface is provided within a predetermined region of the pressure surface of the blade on a hub side. The predetermined region is arranged as part of a radial width of the blade.

7 Claims, 6 Drawing Sheets

(56) References Cited

U.S. PATENT DOCUMENTS

| | | | | |
|---|---|---|---|---|
| 8,911,215 | B2 * | 12/2014 | Cornelius | F01D 5/141 416/242 |
| 9,816,521 | B2 * | 11/2017 | Kumon | F04D 29/681 |
| 2005/0053493 | A1 * | 3/2005 | Chung | F04D 29/384 417/423.3 |
| 2013/0156561 | A1 | 6/2013 | Otsuka et al. | |
| 2015/0071786 | A1 | 3/2015 | Kumon et al. | |
| 2016/0076546 | A1 * | 3/2016 | Arnold | F04D 25/166 416/179 |
| 2018/0038384 | A1 | 2/2018 | Kumon et al. | |

FOREIGN PATENT DOCUMENTS

| | | | |
|---|---|---|---|
| CN | 104145118 | A | 11/2014 |
| EP | 1 574 716 | A1 | 9/2005 |
| JP | 03-064697 | A | 3/1991 |
| JP | H08-121391 | A | 5/1996 |
| JP | H10-141284 | A | 5/1998 |
| JP | 2011-069375 | A | 4/2011 |

OTHER PUBLICATIONS

Written Opinion for corresponding International Application No. PCT/JP2016/079783 dated Dec. 19, 2016.
Chinese Office Action for Application No. 201680058325.2, dated Mar. 21, 2019.
International Preliminary Report on Patentability for corresponding International Application No. PCT/JP2016/079783 dated Apr. 10, 2018.

* cited by examiner

AXIAL FAN

CROSS REFERENCE TO RELATED APPLICATIONS

The present application is a continuation application of International Application No. PCT/JP2016/079783, filed on Oct. 6, 2016, which claims priority to Japanese Patent Application No. 2015-199714, filed on Oct. 7, 2015. The contents of these applications are incorporated herein by reference in their entirety.

BACKGROUND

Technical Field

The present disclosure relates to an impeller and an axial fan including the impeller.

Background Art

Conventionally, in the interest of noise abatement, an impeller for an axial fan has been known, the impeller including a roughly cylindrical hub and a plurality of blades arranged around the hub in which the shape of the leading edge of the blade is straight and the leading edge is leaned forward in the rotation direction so that an angle ∠BHO formed by an intersection B of the leading edge of the blade and the hub, an outer circumferential end H of the leading edge of the blade, and the center O of a rotating shaft is 8 degrees to 16 degrees on a projection plane when projected on a plane which is perpendicular to a rotating shaft, and a triangular flat plate including apexes at the outer circumferential end H and ahead of the leading edge in the rotation direction is arranged at an outer circumferential side of the leading edge (see Japanese Laid-Open Patent Publication No. 03-064697).

In recent years, there has been an increasing need to reduce power consumption without deterioration of the airflow characteristics of a fan.

The present disclosure is related to provide an impeller for reducing power consumption without deterioration of the airflow characteristics of a fan, and an axial fan including the impeller.

SUMMARY

The present disclosure includes the following features:

(1) An impeller of the present disclosure includes a hub and a plurality of blades disposed on an outer circumference of the hub, wherein a pressure surface of the blade is at least partially a convex surface which is bulging from a suction surface side to a pressure surface side, and the convex surface is provided within a predetermined region of the pressure surface of the blade on a hub side.

(2) According to the feature of (1) above, the predetermined region is arranged within 50% of a radial width of the blade.

(3) According to the feature of (2) above, the predetermined region is arranged within 45% of the radial width of the blade.

(4) According to any one of the features of (1) to (3) above, the predetermined region is a range extending between points lying circumferentially inward by 5% or more of a circumferential width of the blade from a leading edge portion, which is a foremost side of the blade in the rotation direction of the impeller, and points lying circumferentially inward by 5% or more of the circumferential width of the blade from a trailing edge portion, which is a rearmost side of the blade in the rotation direction of the impeller.

(5) According to the feature of (4) above, the predetermined region is a range extending between points lying circumferentially inward by 10% or more of the circumferential width of the blade from the leading edge portion, which is the foremost side of the blade in the rotation direction of the impeller, and points lying circumferentially inward by 10% or more of the circumferential width of the blade from the trailing edge portion, which is the rearmost side of the blade in the rotation direction of the impeller.

(6) According to any one of the features of (1) to (5) above, the convex surface becomes smaller in bulge amount as the blade radially outwardly extends from the hub so as not to go bulging as the blade radially outwardly extends from the hub.

(7) According to any one of the features of (1) to (6) above, the convex surface is in a bulging state in which, when the length of an arc obtained as the blade is cut in an arc shape in the circumferential direction at an equal distance from the center of rotation along the convex surface is L and the bulge height of the convex surface positioned on the arc is H, even a bulge height H at a point where the bulge height H is the highest falls within a height of 5% of the length L of the arc.

(8) An axial fan of the present disclosure includes an impeller including any one of the features of (1) to (7) above.

According to the present disclosure, an impeller for reducing power consumption without deterioration of the airflow characteristics of a fan, and an axial fan including the impeller are provided.

BRIEF DESCRIPTION OF DRAWINGS

In FIG. 3A, the left drawing illustrating the blade cut at the position of 10% of the radial width of the blade from a hub side and the right drawing is a cross-sectional view illustrating only the cut surface of the blade. In FIG. 3B, the left drawing illustrating the blade cut at the position of 35% of the radial width of the blade from the hub side and the right drawing is a cross-sectional view illustrating only the cut surface of the blade. In FIG. 3C, the left drawing illustrating the blade cut at the position of 50% of the radial width of the blade from the hub side and the right drawing is a cross-sectional view illustrating only the cut surface of the blade. In FIG. 3D, the left drawing illustrating the blade cut at the position of 90% of the radial width of the blade from the hub side and the right drawing is a cross-sectional view illustrating only the cut surface of the blade.

FIG. 4A is a drawing illustrating a flow of air at the position of 10% of the radial width of the blade from the hub side. FIG. 4B is a drawing illustrating a flow of air at the position of 90% of the radial width of the blade from the hub side.

FIG. 6A is cross-sectional views of the blade at the positions of 10% and 50% of the radial width of the blades from the hub side according to the embodiment. FIG. 6B is cross-sectional views of the blade at the positions of 10% and 50% of the radial width of the blades from a hub side according to the comparative example.

DESCRIPTION OF EMBODIMENTS

Figure 1:
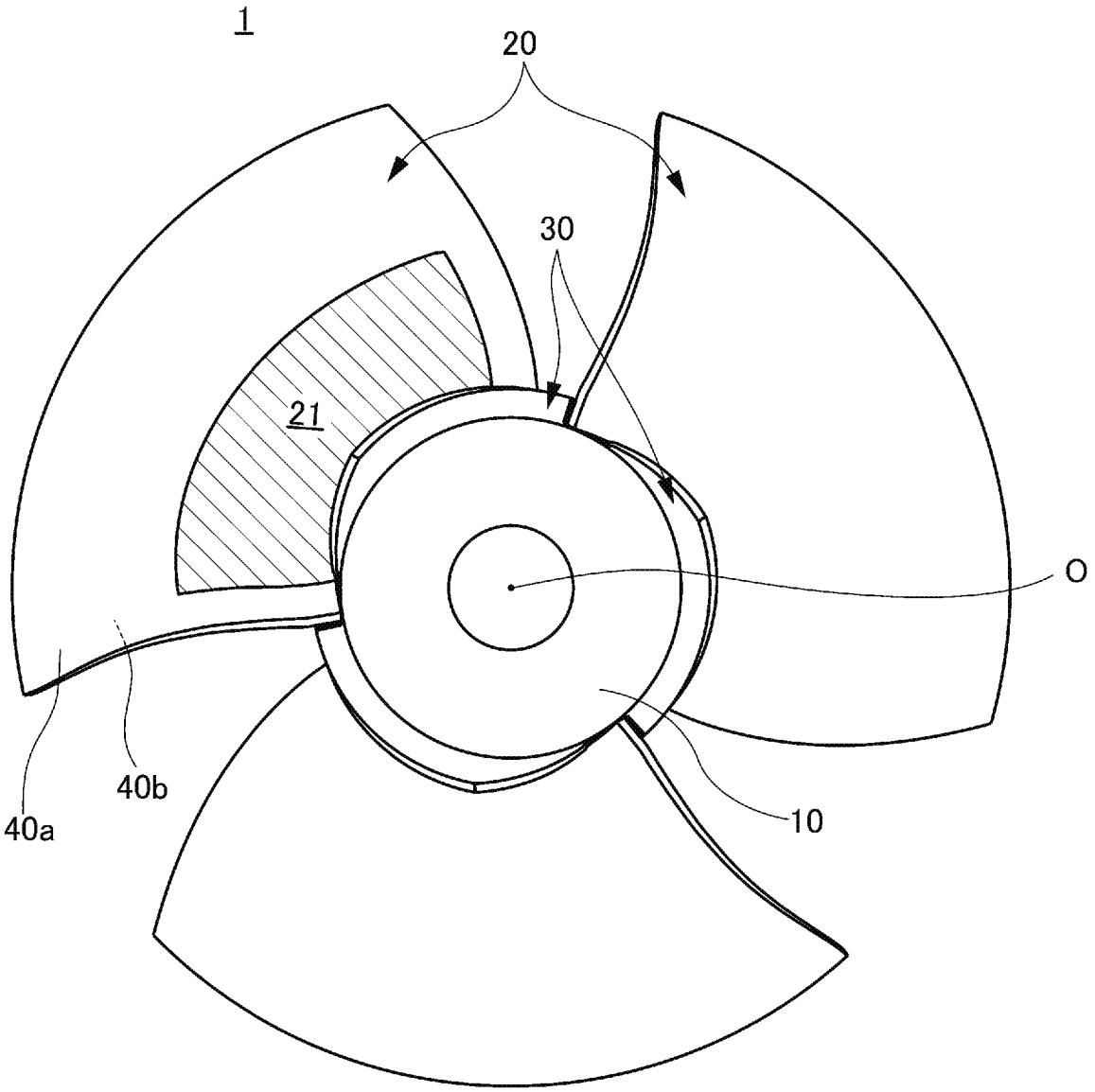
FIG. 1 is a front view illustrating a suction surface of an impeller according to an embodiment of the present disclosure.

In the following, an aspect for implementing the present disclosure (hereinafter the "embodiment") is described in detail on the basis of the accompanying drawings.

Like elements are given like reference numerals throughout the description of the embodiment.

FIG. 1 is a front view of an impeller 1 according to the embodiment of the present disclosure.

In the state of FIG. 1, suction surfaces 40*a* of the impeller 1, which face an air sucking suction port when the impeller 1 is used in an axial fan, are viewed frontally.

The impeller 1 illustrated in FIG. 1 is used, for example, for a cooling axial fan for use in a refrigerator or the like.

As illustrated in FIG. 1, the impeller 1 includes a hub 10 and three (multiple) blades 20. The blades 20 and the hub 10 are integrally formed by means, for example, of injection molding such that the blades 20 are integrated with the hub 10 at mounting portions 30 in a manner that the blades 20 are disposed on the outer circumference of the hub 10 at roughly equal intervals in the circumferential direction.

(Hub)

The hub 10 has a bottomed cylindrical shape and a motor for rotating the impeller 1 is disposed inside the hub 10.

For example, a motor to be disposed on a base portion of a casing of an axial fan, which is not illustrated, is disposed inside the hub 10, and the motor rotates the impeller 1 about a rotary axis O counterclockwise.

(Blades)

When the impeller 1 is rotated, the blades 20 form a flow of air flowing from the above in the plane of paper of FIG. 1 toward the far side in the plane of paper of FIG. 1.

As described above, FIG. 1 is a front view frontally illustrating the air suction port side in the case of an axial fan. Therefore, when the impeller 1 is rotated to produce a flow of air, the air flows and is delivered along the surfaces opposite to the surfaces of the blades 20 as viewed in FIG. 1.

Therefore, the surfaces opposite to the surfaces of the blades 20 as viewed in FIG. 1 are the surfaces (pressure surfaces 40*b*) that are subjected to pressure when air is delivered. The surfaces of the blades 20 as viewed in FIG. 1 are suction surfaces 40*a* which are brought into a negative pressure state.

As will be described in detail below, the pressure surfaces 40*b* of the blades 20 are at least partially convex surfaces which bulge from a suction surface 40*a* side to a pressure surface 40*b* side.

The convex surface is provided in a predetermined region 21 of the blade 20 on the side of the hub 10 illustrated in FIG. 1. A specific description is given below. In FIG. 1, the region 21 is explicitly described with regard to only one blade 20. However, the same applies to the two other blades 20.

(Predetermined Region)

First, the specific range of the predetermined region 21 on the blade 20 is described with reference to FIG. 2.

Figure 2:
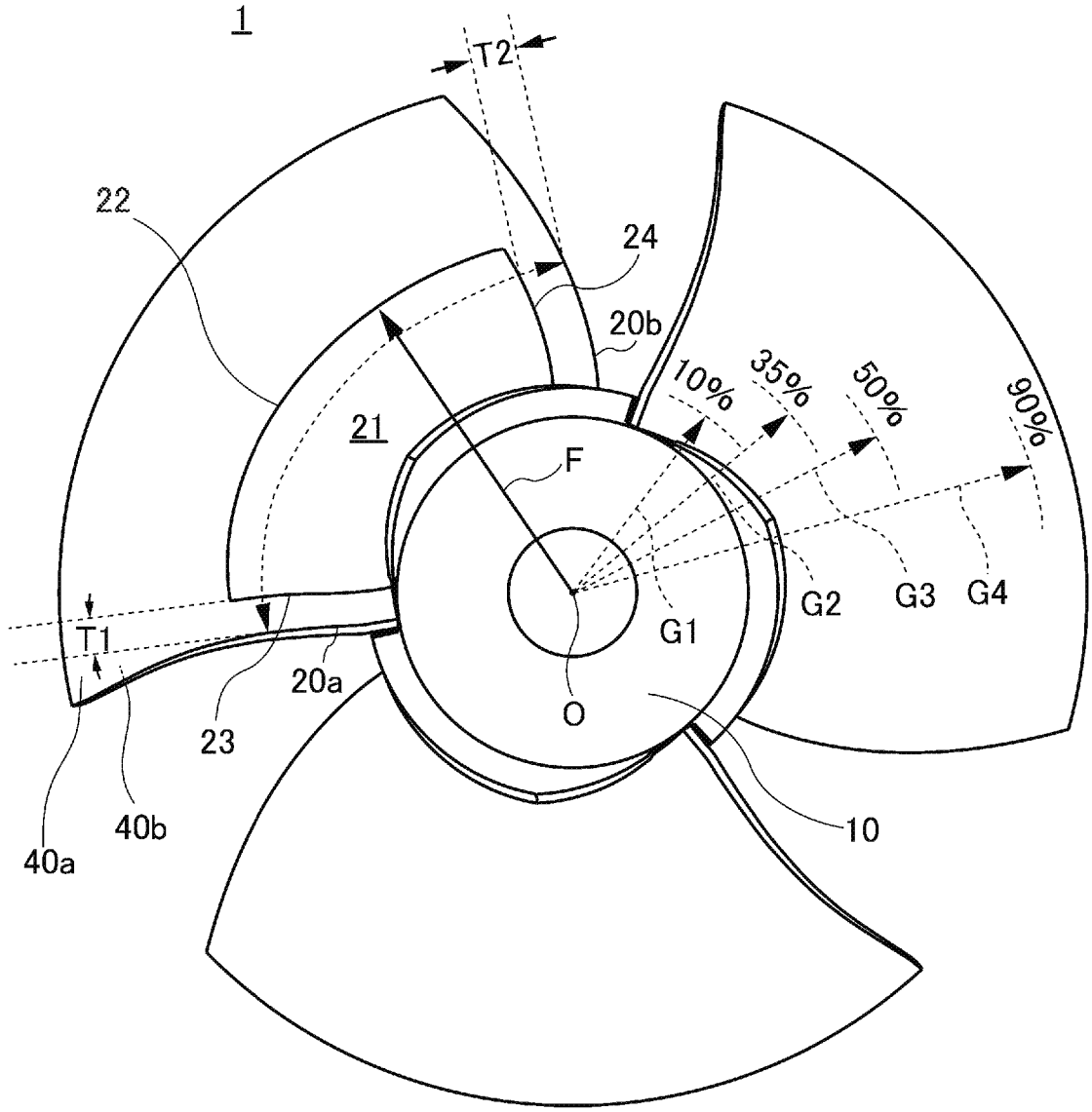
FIG. 2 is a front view in a similar way to FIG. 1, for an explanation of a predetermined region and other constitutions.

FIG. 2 is a front view of the blades 20, which is basically the same as FIG. 1. Some of the reference numerals, which are the same as those of FIG. 1, are omitted to provide a clear view of the drawing when the region 21 and other constitutions are described.

As illustrated in FIG. 2, a region boundary line 22 defining the radially outer side of the region 21 is a line drawn by the circumferential rotation of an arrow F illustrated in FIG. 2 about the rotary axis O of the impeller 1.

Specifically, the region boundary line 22 is a line defined by an arc drawn at an equal distance from the rotary axis O of the impeller 1. In FIGS. 1 and 2, the region boundary line 22 is an arc passing through a roughly central position of the radial width of the blade 20 (about 50% of the radial width of the blade 20). However, it is more preferable that the region boundary line 22 is an arc passing through the position of about 45% of the radial width of the blade 20 from the hub 10 radially outward.

A region boundary line 23 defining one circumferential end of the predetermined region 21 is a line drawn along points lying inward by a predetermined length T1 from a leading edge portion 20*a*, which is the foremost side of the blade 20 in the rotation direction of the impeller 1.

More specifically, the region boundary line 23 is a line drawn in such a manner that multiple arcs with different distances from the rotary axis O of the impeller 1 are drawn and, with reference to the length L of each arc, the points situated inward by a length T1 along the arcs from the points of the leading edge portion 20*a* intersecting with the arcs are connected.

Furthermore, the predetermined length T1 is preferably a length of about 5% relative to the length L of the arc, which is the reference, (T1=L×0.05), more preferably a length of about 10% (T1=L×0.1).

Specifically, the region boundary line 23 defining one circumferential end of the predetermined region 21 preferably lies about 5% inward (circumferentially inward) on the blade 20 from the leading edge portion 20*a* with respect to the circumferential width of the blade 20, more preferably lies about 10% inward on the blade 20.

The region boundary line 24 defining the other circumferential end of the predetermined region 21 is a line drawn along points lying inward by a predetermined length T2 from a trailing edge portion 20*b*, which is the rearmost side of the blade 20 in the rotation direction of the impeller 1.

Similar to the region boundary line 23, the region boundary line 24 is also a line drawn in such a manner that multiple arcs with different distances from the rotary axis O of the impeller 1 are drawn and, with reference to the length L of each arc, the points situated inward by a length T2 along the arcs from the points of the trailing edge portion 20*b* intersecting with the arcs are connected. The predetermined length T2 is preferably a length of about 5% relative to the length L of the arc, which is the reference, (T2=L×0.05), more preferably a length of about 10% (T2=L×0.1).

Specifically, the region boundary line 24 defining the other circumferential end of the predetermined region 21 preferably lies about 5% inward (circumferentially inward) on the blade 20 from the trailing edge portion 20*b* with respect to the circumferential width of the blade 20, more preferably lies about 10% inward on the blade 20.

(Convex Surface)

The bulging state of the convex surface provided in the pressure surface 40*b* within the predetermined region 21, which is defined in the manner as described above, is described in detail with reference to the drawings.

Figures 3A, 3B, 3C, 3D:
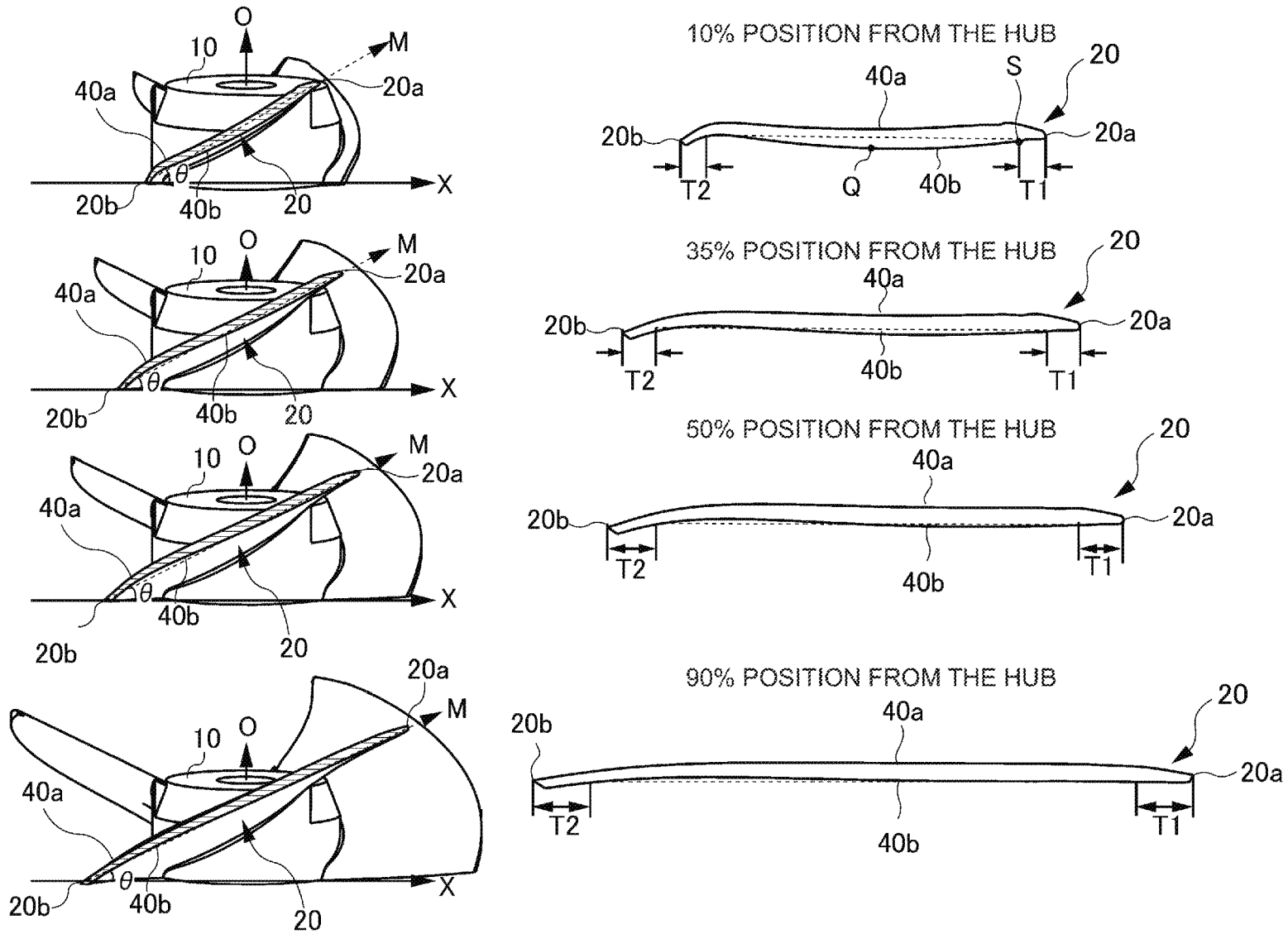
FIGS. 3A to 3D are figures illustrating a state of a convex surface in a radial direction of a blade according to the embodiment of the present disclosure.

FIGS. 3A to 3D are figures illustrating a state of the convex surface in a radial direction of the blade 20. In FIG. 3A, the left drawing is the blade 20 cut at the position of 10% of the radial width of the blade 20 from the hub (see dotted arrow G1 in FIG. 2) and the right drawing is a view illustrating the cut surface of the blade 20 only.

FIGS. 3B, C and D are similar to FIG. 3A, but different from FIG. 3A in that the positions at which the blades 20 is cut lie at 35% (see dotted arrow G2 in FIG. 2), 50% (see dotted arrow G3 in FIG. 2), and 90% (see dotted arrow G4 in FIG. 2) of the radial width of the blades 20 from the hub.

In the left drawings of FIGS. 3A to D, the X axis represents an axis perpendicular to the rotary axis O of the impeller 1.

Furthermore, in the left drawings of FIGS. 3A to D, the M axis represents an axis connecting the leading edge portion 20*a* and the trailing edge portion 20*b* of the blade 20. The angle θ (an angle on the acute angle side) between the X axis and the M axis is substantially a mounting angle of the blade 20 with respect to the hub 10 (the mounting angle is within a range of 24 degrees to 27 degrees).

The right drawings illustrate only the cut surfaces (hatched portions) of the blades 20 of the left drawings of FIGS. 3A to D. In the right drawings, the cross-sections of the blades 20 are illustrated in a manner that the cross-sections of the blades 20 are roughly parallel with each other.

In FIGS. 3A to D, the cut surfaces appear to be planar since the cut surfaces are viewed laterally. However, as described above, since the cut surfaces themselves draw arcs in the circumferential direction of the hub 10, the cut surfaces actually have an arc shape.

Furthermore, the dotted lines illustrated in the right drawings of FIGS. 3A to D indicate a line connecting the points on the blades 20 displaced inward from the leading edge portion 20*a* and the trailing edge portion 20*b* by the lengths T1 and T2 (T1=L×0.05, T2=L×0.05) of about 5% along the cut surface with reference to the arc length L of the cut surface of the blade 20.

As can be seen from a comparison of the right drawings of FIGS. 3A to 3D, at the position of 10% of the radial width of the blade 20 from the hub (see FIG. 3A), the pressure surface 40*b* of the blade 20 is bulging from the suction surface 40*a* side to the pressure surface 40*b* side within the aforementioned range on the blade 20 extending between the points lying about 5% inward from the leading edge portion 20*a* and the points lying about 5% inward from the trailing edge portion 20*b*. Specifically, it can be seen that the pressure surface 40*b* is a convex surface.

Subsequently, the change of the state of the convex surface in FIG. 3A is seen toward the radial outside of the blade 20 in the order of 3B→C→D. At the position of 35% of the radial width of the blade 20 from the hub 10 in FIG. 3B, the bulging state is reduced in size, but still remains in a convex surface state. At the position of 50% of the radial width of the blade 20 from the hub 10 in FIG. 3C, the convex surface almost disappears and is in a generally flat state. Furthermore, conversely, at the position of 90% of the radial width of the blade 20 from the hub in FIG. 3D, the pressure surface 40*b* is a recessed surface, which is gently recessed toward the suction surface 40*a*.

As described above, within the predetermined region 21 of the blade 20 on the hub 10 side described with reference to FIG. 1, the convex surface is formed on the pressure surface 40*b*. More specifically, the convex surface becomes smaller in bulge amount as the blade 20 radially outwardly extends from the hub 10 side so as not to go bulging as the blade 20 radially outwardly extends from the hub 10 side.

In a different expression, the convex surface is becomes smaller in bulge amount as the blade 20 radially outwardly extends from the hub 10 side so as not to go expanding as the blade 20 radially outwardly extends from the hub 10 side and gradually comes into a flat state.

Incidentally, as can be seen from the right drawings of FIGS. 3A and B, regarding the blade 20 of the present embodiment, the suction surface 40*a* in the portion where the pressure surface 40*b* is the convex surface is formed into a recessed surface, which is recessed from the suction surface 40*a* side to the pressure surface 40*b* side.

Specifically, even when looking at the blade 20 itself, the aforementioned predetermined region 21 is formed in a shape bulging from the suction surface 40*a* side to the pressure surface 40*b* side.

An assumed flow of air during rotation of the impeller 1 according to the present embodiment including the blade 20 having the aforementioned shape is described.

Figure 4A:
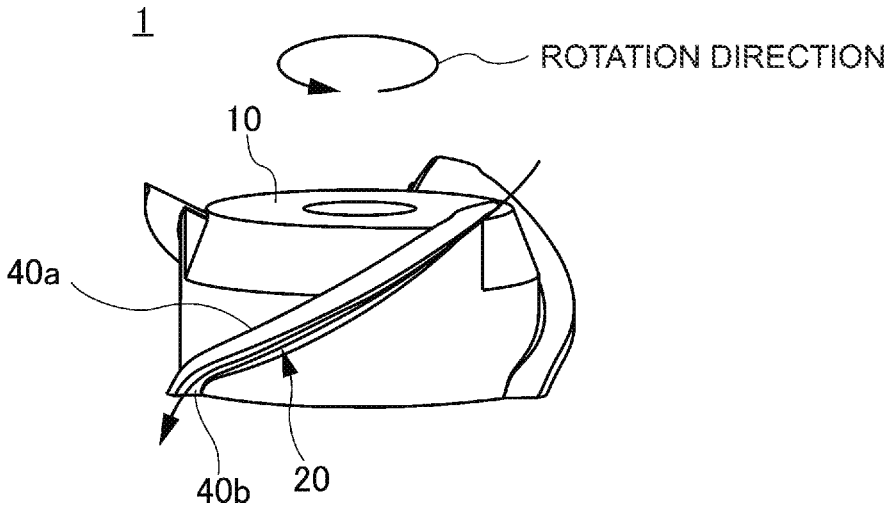
FIGS. 4A and 4B are figures illustrating a flow of air during rotation of the impeller according to the embodiment of the present disclosure.

FIGS. 4A and B illustrates the right-hand drawings of FIGS. 3A and D. In FIGS. 4A and B, the flow of air flowing over the pressure surface 40*b* of the blade 20 during counterclockwise rotation of the impeller 1 is schematically illustrated.

As described with reference to FIG. 3A, on the hub 10 side of the pressure surface 40*b* illustrated in FIG. 4A, a convex surface is formed. Therefore, in the case of an axial fan, air is easily pressed toward the air outlet port (lower side in the drawing).

Therefore, it is assumed that a large amount of air is blown out even under conditions where air is hardly blown out (high static pressure conditions) at the outlet port of an axial fan whereby the static pressure characteristics are improved.

However, the impeller 1 is subjected to an increased load when the air is forced out. Therefore, under ordinary circumstances, it is expected that there is some disadvantage in terms of power consumption.

Figure 4B:
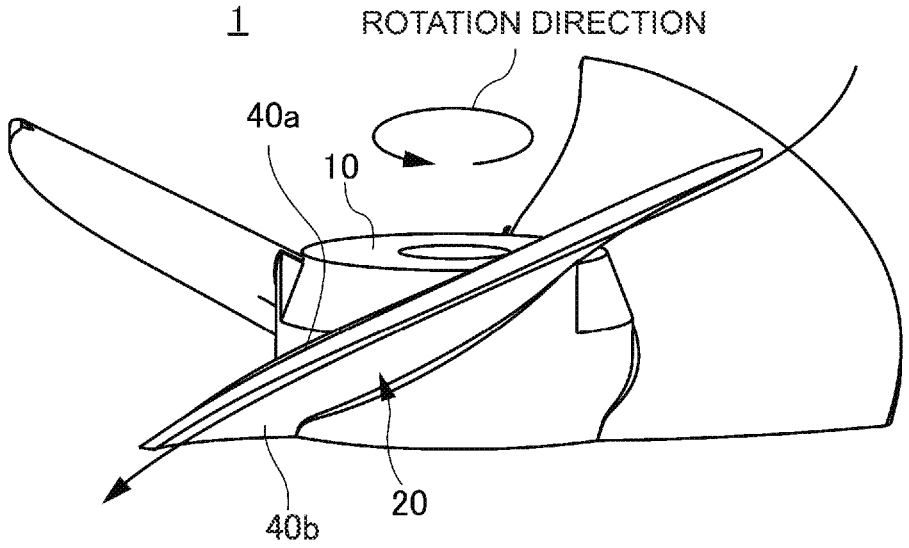

As described with reference to FIG. 3D, the part of the pressure surface 40*b* away from the hub 10 illustrated in FIG. 4B does not include a convex surface. Rather, the pressure surface 40*b* is in a recessed surface state, which is roughly similar to that of a general impeller.

Therefore, in the case of an axial fan, it is assumed that the capability of pressing the air toward the air outlet port (lower side in the drawing) is equivalent to that of a general impeller. Furthermore, it is expected that, with regard to power consumption, the impeller 1 is also equivalent to a general impeller.

Figure 5:
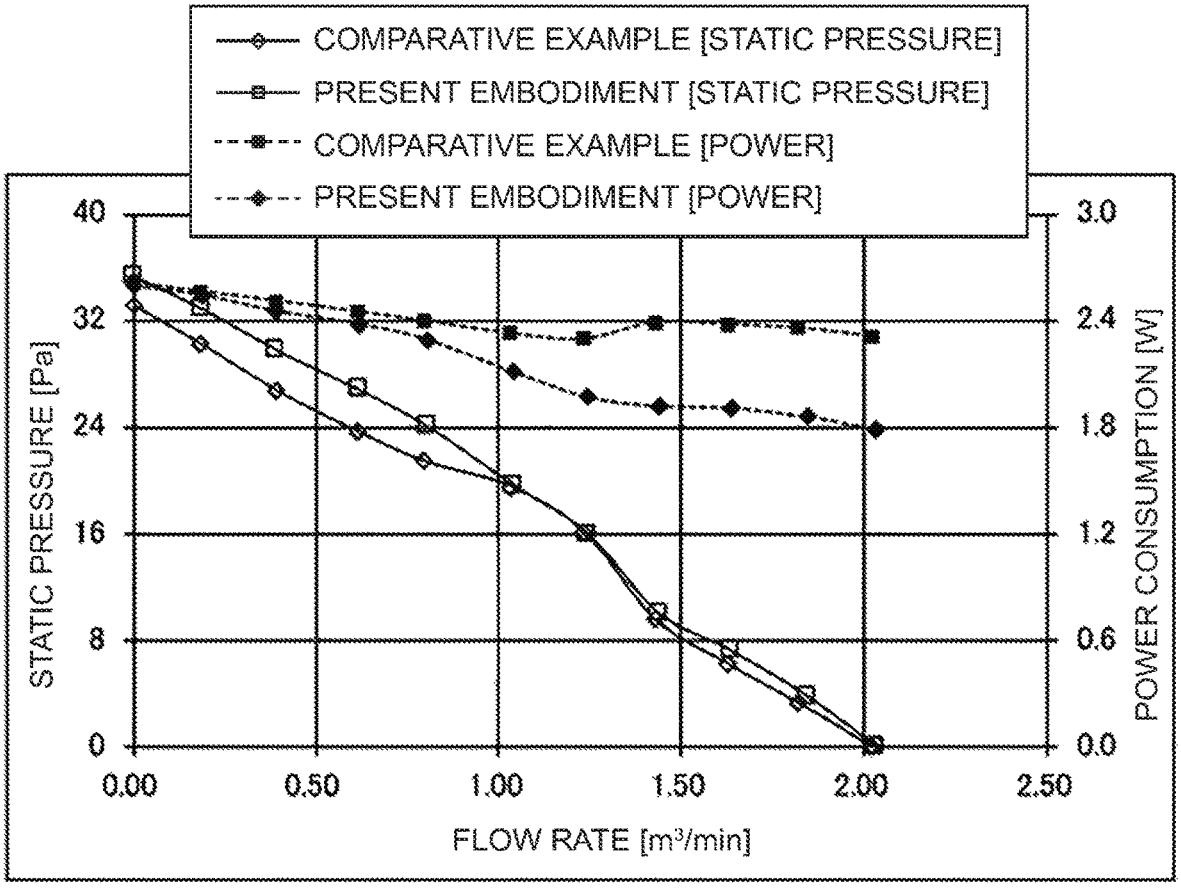
FIG. 5 shows a graph comparing the performances of an axial fan using the impeller according to the embodiment of the present disclosure and an axial fan using an impeller according to a comparative example.

From the foregoing, as compared to an axial fan with a general impeller, it is expected that the static pressure characteristics are improved, but the performance regarding power consumption is slightly degraded. However, as illustrated in FIG. 5, obtained results contradict such expectations.

The impeller 1 of the embodiment according to the present disclosure is further described below with reference to FIGS. 5 and 6A, B.

Figure 6B:
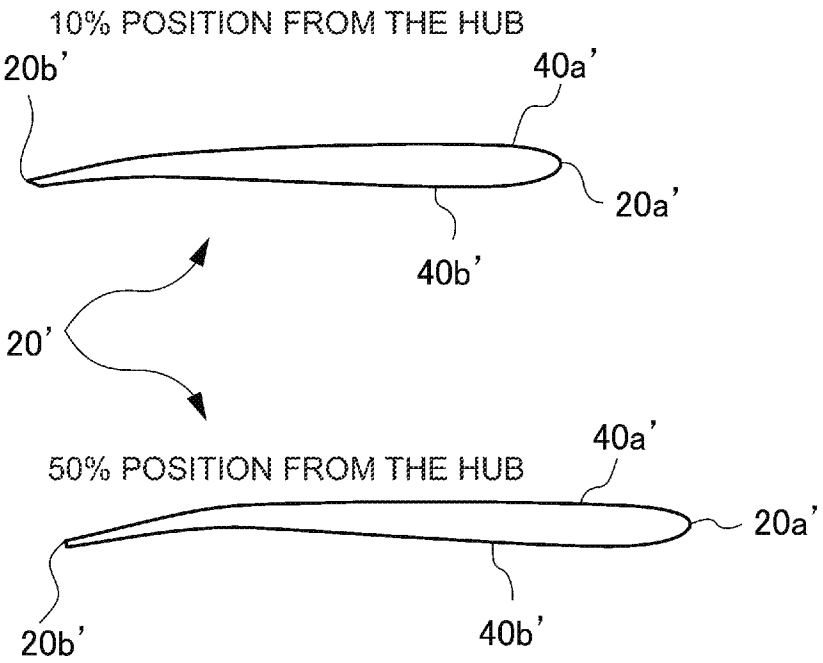
FIGS. 6A and 6B are figures for comparing the shape of the blade according to the embodiment of the present disclosure and the shape of a blade according to the comparative example.
Figure 6A:
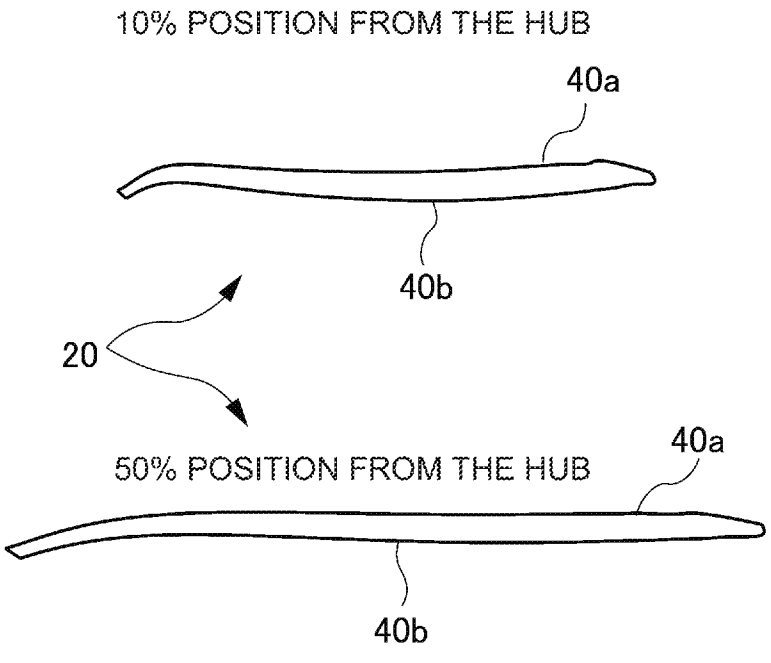

FIGS. 6A and 6B are figures for comparing the cross-sectional shapes of the blade 20 of the present embodiment and a blade 20' of a comparative example. FIG. 6A illustrates the cross-sections of the blades 20 illustrated in the right drawings of FIGS. 3A and C, i.e., the cross-sections at the positions of 10% (upper drawing) and 50% (lower drawing) of the radial width of the blade 20 from the hub 10 side.

Furthermore, FIG. 6B is drawings illustrating the cross-sections of the blades 20' of the comparative example, i.e., the cross-sections at the positions of 10% (upper drawing) and 50% (lower drawing) of the radial width of the blade 20' from the hub side.

Incidentally, in FIG. 6B, the leading edge portion is indicated at 20*a*', the trailing edge portion is indicated at 20*b*', the suction surface is indicated at 40*a*', and the pressure surface is indicated at 40*b*'.

In FIG. 6B, a general impeller is simulated. The blade 20', also at a side near the hub (the positions of 10% and 50% from the hub), has a shape similar to that in the right drawing of FIG. 3D (the position of 90% of the radial width of the blade 20 from the hub 10 side). Specifically, the blade 20' is shaped such that the pressure surface 40*b*' has a recessed surface toward the trailing edge portion 20*b*' side.

FIG. 5 shows a graph for comparing the performances of the axial fan of the comparative example using an impeller including the aforementioned blade 20' and the axial fan of the present embodiment including the impeller 1 of the present embodiment.

In FIG. 5, the horizontal axis represents airflow [$m^3$/min], the left vertical axis represents static pressure [Pa], and the right vertical axis represents power consumption [W]. The relationship between airflow and static pressure of the axial fan including the impeller 1 of the present embodiment and the axial fan including the impeller of the comparative example is illustrated by the solid line graphs, and the relationship between airflow and power consumption is illustrated by the dotted line graphs.

As illustrated in FIG. 5, the axial fan including the impeller 1 of the present embodiment has less power consumption as compared to the axial fan including the impeller of the comparative example across the entire range of airflow. In particular, it can be seen that the reduction effect increases with increases in airflow.

Also regarding static pressure characteristics, the axial fan including the impeller 1 of the present embodiment has superior results than the axial fan including the impeller of the comparative example across almost the entire range of airflow. In particular, it can be seen that the static pressure characteristics are appreciably improved in the region where airflow is small.

As described above, when the pressure surface 40*b* includes a convex surface to enhance the capability of forcing out air, the resistance during rotation of the impeller 1 is increased. Therefore, it is thought that there is a disadvantage in terms of power consumption.

In light of the above, the present embodiment whereby the pressure surface 40*b* is a convex surface in the predetermined region 21 on the side near the hub 10 as described with reference to FIG. 1 is expected to be somewhat disadvantageous in terms of power consumption. However, it is found that, when the convex surface is provided at an inner side only and the region at an outer side of the blade 20 (the outer region of the predetermined region 21) is free of a convex surface, the static pressure characteristics are improved and the power consumption is reduced.

This is because, although it is speculative, when the impeller 1 is rotated to deliver air, the air does not vertically flow in the blowing direction, but flows along the pressure surface 40*b* toward the outside of the impeller 1 on the basis of a centrifugal component.

Furthermore, it is thought that the centrifugal component is increased as the rotation rate of the impeller 1 is increased, i.e., as the airflow is increased. Furthermore, it is thought that a load on the impeller 1 is greater when a part of the blade 20 away from the center of rotation (rotary axis O) presses air than when a part of the blade 20 near the center of rotation (rotary axis O) presses air.

In light of the above, the region where the rotation of the impeller is slow and airflow is small in FIG. 5 involves a small centrifugal component. Therefore, a great amount of air is present over the hub 10 side of the pressure surface 40*b* of the blade 20, and the air is efficiently delivered to the outlet port of the axial fan by the convex surface. Since this part is on the hub 10 side, i.e., close to the rotary axis O, the impeller 1 is subjected to a less increased load. In consideration of the balance between efficient air delivery and load increment, it is assumed that power consumption itself is reduced.

As the rotation rate of the impeller 1 is increased, then the airflow is increased, the centrifugal component is increased, and then, the outer side of the blade 20 is subjected to loads by the air. However, it is assumed that the presence of the convex surface on the hub 10 side of the blade 20 increases the rate of air which is blown through the outlet port of the axial fan and does not flows toward the outer side of the blade 20 where the impeller 1 is subjected to a large load, and the impeller 1 is subjected to an appreciably reduced load as a whole, thereby leading to a reduction in power consumption.

In view of the above, it is preferable that the convex surface is provided in the range of the aforementioned predetermined region 21 of the pressure surface 40*b*, i.e., in the range of the blade 20 near the hub 10, and that the bulge amount of the convex surface becomes smaller as the blade 20 radially outwardly extends. This is because it is thought that the impeller 1 is not subjected to an increased load, the air is efficiently delivered, and thus power consumption is reduced.

According to both the present embodiment and the comparative example, there is a tendency that power consumption is reduced when the airflow is large. This is because it is thought that when the rotation rate is increased, the rotational force of the impeller 1 itself is added, and the power consumption required for maintaining the rotation is reduced.

Now, the bulge amount of the convex surface is described. The bulge amount may be defined as a distance between the height positions of two arbitrary points taken on the convex surface within the range of the dotted line in the right drawing of FIG. 3A.

For example, according to the present embodiment, in the right drawing of FIG. 3A, the most bulging point (lowest point) of the convex surface is a point, Q, slightly close to the trailing edge portion 20*b* from the center of the convex surface, and the uppermost point (highest point) in the region of the convex surface is a point, S, near the leading edge portion 20*a*.

The distance between the two points in the height direction, i.e., for example, the distance between the points Q and S when the point S is moved to the position immediately above the point Q, is the bulge amount of the convex surface.

When the bulge amount of each of the cross-sections of different radial points of the blade 20 is viewed, there is a point of the largest bulge amount, i.e., a point where the bulge height H is the highest. The bulge height H of the point with the largest bulge amount preferably falls within a height of 5% of the length L of the arc of the cut surface passing through the point of the largest bulge amount, and more preferably falls within 3%.

This is because, although an increase of the bulge amount of the convex surface increases the air blowing force of the axial fan, an undue increase in bulge amount is not desirable in terms of load on the impeller 1.

Therefore, even when the bulge height H of the point where the bulge height H is the highest in the convex surface exceeds 5% of the length L of the arc of the cut surface passing through the point where the bulge height H is the highest, the effect is still obtained. However, only as a guide, the bulge height H is preferably within 5%.

Incidentally, in the present embodiment, the convex surface formed in the predetermined region 21 at the position of 0% of the radial width of the blade 20 from the hub 10 side to the outside of the blade 20, i.e., at the position of the blade 20 along the hub 10, is formed to have the largest bulge. The bulge height H of this convex surface is a height of about 3% of the length L of the arc of the cut surface passing through the point where the bulge height H is the highest (i.e., the length of the outer circumferential arc of the hub 10 contacting the blade 20).

Hereinbefore, the present disclosure has been described on the basis of the embodiment. However, the present disclosure is not limited to the embodiment, but various modifications may be made without departing from the gist of the present disclosure.

For example, in the present embodiment, the case of the impeller 1 is described where three blades 20 are disposed at roughly equal intervals in the circumferential direction with respect to the hub 10. However, the number of blades 20 is not limited to three, but may be four. The number of blades may be determined on an as needed basis.

Furthermore, in the present embodiment, as a use aspect of the impeller 1, the case of an axial fan has been described. However, the use aspect is not limited to an axial fan, but may be changed as necessary.

As described above, the present disclosure is not limited to the specific embodiment, but may include various modifications as is apparent to those skilled in the art from the statements of the claims.

What is claimed is:

1. An axial fan, comprising an impeller, wherein the impeller comprises a hub and a plurality of blades disposed on an outer circumference of the hub, a pressure surface of each of the blades is at least partially a convex surface bulging from a suction surface side to a pressure surface side, the convex surface is provided within a predetermined region of the pressure surface of the blade on a hub side, and the predetermined region is arranged as part of a radial width of the blade, and the convex surface is in a bulging state in which, when a length of an arc obtained as the blade is cut in an arc shape in a circumferential direction at an equal distance from a center of rotation along the convex surface is L and a bulge height of the convex surface positioned on the arc is H, even a bulge height H at a point where the bulge height H is the highest falls within a height of 5% of the length L of the arc.

2. An axial fan according to claim 1, wherein the predetermined region is arranged within 50% of the radial width of the blade.

3. An axial fan according to claim 2, wherein the predetermined region is arranged within 45% of the radial width of the blade.

4. An axial fan according to claim 1, wherein the predetermined region is a range extending between points lying circumferentially inward by 5% or more of a circumferential width of the blade from a leading edge portion, which is a foremost side of the blade in a rotation direction of the impeller, and points lying circumferentially inward by 5% or more of the circumferential width of the blade from a trailing edge portion, which is a rearmost side of the blade in the rotation direction of the impeller.

5. An axial fan according to claim 4, wherein the predetermined region is a range extending between points lying circumferentially inward by 10% or more of the circumferential width of the blade from the leading edge portion, which is the foremost side of the blade in the rotation direction of the impeller, and points lying circumferentially inward by 10% or more of the circumferential width of the blade from the trailing edge portion, which is the rearmost side of the blade in the rotation direction of the impeller.

6. An axial fan according to claim 1, wherein the convex surface becomes smaller in bulge amount as the blade radially outwardly extends from the hub so as not to go bulging as the blade radially outwardly extends from the hub.

7. An axial fan according to claim 1, wherein an angle between an axis perpendicular to a rotary axis of the impeller and an axis connecting a leading edge portion and a trailing edge portion of the blade at a radial width of the blade is within a range of 24 degrees to 27 degrees.

* * * * *